US009011029B2

(12) United States Patent
Ehara

(10) Patent No.: US 9,011,029 B2
(45) Date of Patent: Apr. 21, 2015

(54) PRINTING APPARATUS WITH RIBBON WINDING UNIT HAVING FIRST AND SECOND MOVEABLE GEARS

(71) Applicant: SEIKO Precision Inc., Narashino-shi, Chiba (JP)

(72) Inventor: Koji Ehara, Narashino (JP)

(73) Assignee: SEIKO Precision Inc., Narashino-Shi, Chiba (JP)

( * ) Notice: Subject to any disclaimer, the term of this patent is extended or adjusted under 35 U.S.C. 154(b) by 0 days.

(21) Appl. No.: 14/342,453

(22) PCT Filed: Dec. 28, 2012

(86) PCT No.: PCT/JP2012/084225

§ 371 (c)(1),
(2) Date: Mar. 3, 2014

(87) PCT Pub. No.: WO2013/111513

PCT Pub. Date: Aug. 1, 2013

(65) Prior Publication Data

US 2014/0227016 A1 Aug. 14, 2014

(30) Foreign Application Priority Data

Jan. 23, 2012 (JP) ..... 2012-010980

(51) Int. Cl.

| | |
|---|---|
| ***B41J 33/22*** | (2006.01) |
| ***B41J 33/04*** | (2006.01) |
| ***B41J 33/16*** | (2006.01) |
| ***B41J 33/38*** | (2006.01) |
| ***B41J 33/14*** | (2006.01) |

(52) U.S. Cl.

CPC *B41J 33/22* (2013.01); *B41J 33/04* (2013.01); *B41J 33/16* (2013.01); *B41J 33/38* (2013.01); *B41J 33/14* (2013.01)

(58) Field of Classification Search

CPC ..... B41J 33/22; B41J 33/38; B41J 33/16; B41J 33/04

USPC ..... 400/223, 226, 229

See application file for complete search history.

(56) References Cited

U.S. PATENT DOCUMENTS 4,596,480 A * 6/1986 Takada ..... 400/229
4,653,939 A * 3/1987 Hibino ..... 400/120.16

FOREIGN PATENT DOCUMENTS

JP 58-078791 A 5/1983
JP 60-193684 A 10/1985

(Continued)

OTHER PUBLICATIONS

International Search Report—Date of Mailing Mar. 12, 2013.

*Primary Examiner* — Daniel J Colilla

(74) *Attorney, Agent, or Firm* — Howard & Howard Attorneys PLLC

(57) ABSTRACT

The ribbon winding unit is equipped with a first moving gear, a second moving gear, a first intermediate gear, a tumbler gear, and a winding member. The first intermediate gear engages with the first moving gear when the first moving gear and the second moving gear move in a given direction, and disengages from the first moving gear when the first moving gear and the second moving gear move in an opposite direction. The tumbler gear engages with the first intermediate gear, engages with the second moving gear when the first moving gear and the second moving gear move in the opposite direction, and disengages from the second moving gear when the first moving gear and the second moving gear move in the given direction.

5 Claims, 8 Drawing Sheets

(56) References Cited

FOREIGN PATENT DOCUMENTS

| | | | | | |
|---|---|---|---|---|---|
| JP | 61-182976 | A | | 8/1986 | |
| JP | 03262679 | A | * | 11/1991 | ..... B41J 33/40 |
| JP | 5-9967 | U | | 2/1993 | |
| JP | 06-001055 | A | | 1/1994 | |
| JP | 07323647 | A | * | 12/1995 | ..... B41J 33/22 |
| JP | 07323648 | A | * | 12/1995 | ..... B41J 33/22 |

* cited by examiner

PRINTING APPARATUS WITH RIBBON WINDING UNIT HAVING FIRST AND SECOND MOVEABLE GEARS

CROSS REFERENCE TO RELATED APPLICATION

This application is a national stage application of PCT/JP2012/084225, filed Dec. 28, 2012, which claims priority to Japanese Patent Application No. 2012-010980, filed Jan. 23, 2012, the disclosures of which are hereby incorporated by reference in their entirety.

TECHNICAL FIELD

The present invention relates to a printing apparatus that prints using an ink ribbon.

BACKGROUND ART

Printers equipped with a mechanism that winds an ink ribbon with the forward-and-back movement of a carriage are prevalent. Patent Literature 1 discloses one such printer equipped with a mechanism in which a ribbon is wound in only one given direction, regardless of the direction in which the carriage moves.

The printer disclosed in Patent Literature 1 is equipped with an ink ribbon winding mechanism equipped with a rack, a moving gear that moves by engaging with the rack, a gear group that engages with the moving gear, and a winding axle integrally formed with one gear in the gear group.

When the carriage moves in one direction, the moving gear rotates counter-clockwise while moving to a position that abuts (engages with) a first gear. Due to the rotation of the moving gear, the first gear rotates clockwise, causing a second gear to rotate counter-clockwise. Then, the second gear rotates counter-clockwise together with the winding axle, and the ink ribbon is wound by the winding axle.

Also, when the carriage moves in the other direction, the moving gear rotates clockwise while moving to a position that abuts (engages with) a third gear. Due to the rotation of the moving gear, the third gear rotates counter-clockwise, causing an engaged fourth gear to rotate clockwise. The fourth gear then causes the second gear to rotate counter-clockwise. Then, the second gear rotates counter-clockwise together with the winding axle, and the ink ribbon is wound by the winding axle.

Consequently, the ink ribbon is wound in the same direction regardless of the direction in which the carriage moves.

Patent Literature 1: Unexamined Japanese Patent Application Kokai Publication No. S61-182976.

SUMMARY OF INVENTION

Technical Problem

The configuration disclosed in Patent Literature 1 requires space for the moving gear that slides. For this reason, it is difficult to reduce the size of the ink ribbon winding mechanism in the vertical direction (the direction perpendicular to the carriage movement direction), and the configuration is not suitable for reducing the size of the printer.

The present invention, being devised in light of such problems, takes as an objective to reduce the size of a printing apparatus that winds an ink ribbon in a given direction in accordance with movement of a carriage.

Solution to Problem

A printing apparatus according to the present invention is equipped with:

a rack;

a carriage equipped with a printing section and a winding unit that includes a winding axle that winds an ink ribbon; and a driving unit that causes the carriage to move along the rack;

wherein the winding unit includes a first moving gear that engages with the rack, is slidably supported by the carriage, and rotates according to movement of the carriage, while also, due to force applied from the rack during movement of the carriage, moving in an opposite direction inside the carriage with respect to movement of the carriage in a given direction, and moving in the given direction inside the carriage with respect to movement of the carriage in the opposite direction, a second moving gear that engages with the rack, is slidably supported by the carriage, and rotates according to movement of the carriage, while also, due to force applied from the rack during movement of the carriage, moving in an opposite direction inside the carriage with respect to movement of the carriage in a given direction, and moving in the given direction inside the carriage with respect to movement of the carriage in the opposite direction, a first intermediate gear that engages with the first moving gear when the first and second moving gears move in the given direction inside the carriage, and disengages from the first moving gear when the first and second moving gears move in the opposite direction inside the carriage, a second intermediate gear that engages with the first intermediate gear, engages with the second moving gear when the first and second moving gears move in the opposite direction inside the carriage, and disengages from the second moving gear when the first and second moving gears move in the given direction inside the carriage, and a winding member that includes the winding axle and an output gear, disposed coaxially with the winding axle, that engages with the first intermediate gear.

Also, preferably, the first moving gear is hollow inside, the first intermediate gear is a double gear including a first gear that engages with the first moving gear, and a second gear, the output gear engages with the second gear, and the winding member is disposed such that the winding axle is inserted into the first moving gear.

Also, preferably, the first moving gear is a double gear including a third gear that engages with the rack, and a fourth gear, disposed coaxially with the third gear, that engages with the first intermediate gear, and the second moving gear is a double gear including a fifth gear that engages with the rack, and a sixth gear, disposed coaxially with the fifth gear, that engages with the second intermediate gear.

The carriage may also be equipped with a spacer between the first moving gear and the second moving gear that abuts the first moving gear and the second moving gear, and is movable in the same direction as a movement direction of the first moving gear and the second moving gear.

Preferably, the first moving gear and the second moving gear include a flange section that projects out radially, and the spacer is disposed at a position able to abut both the flange sections of the first moving gear and the second moving gear.

Advantageous Effects of Invention

According to the present invention, it is possible to reduce the size of a printing apparatus that winds an ink ribbon in a given direction in accordance with movement of a carriage.

DESCRIPTION OF EMBODIMENTS

Hereinafter, an embodiment of a printing apparatus according to the present invention will be described with reference to the attached drawings, taking a time recorder 10 as an example.

Figure 1:
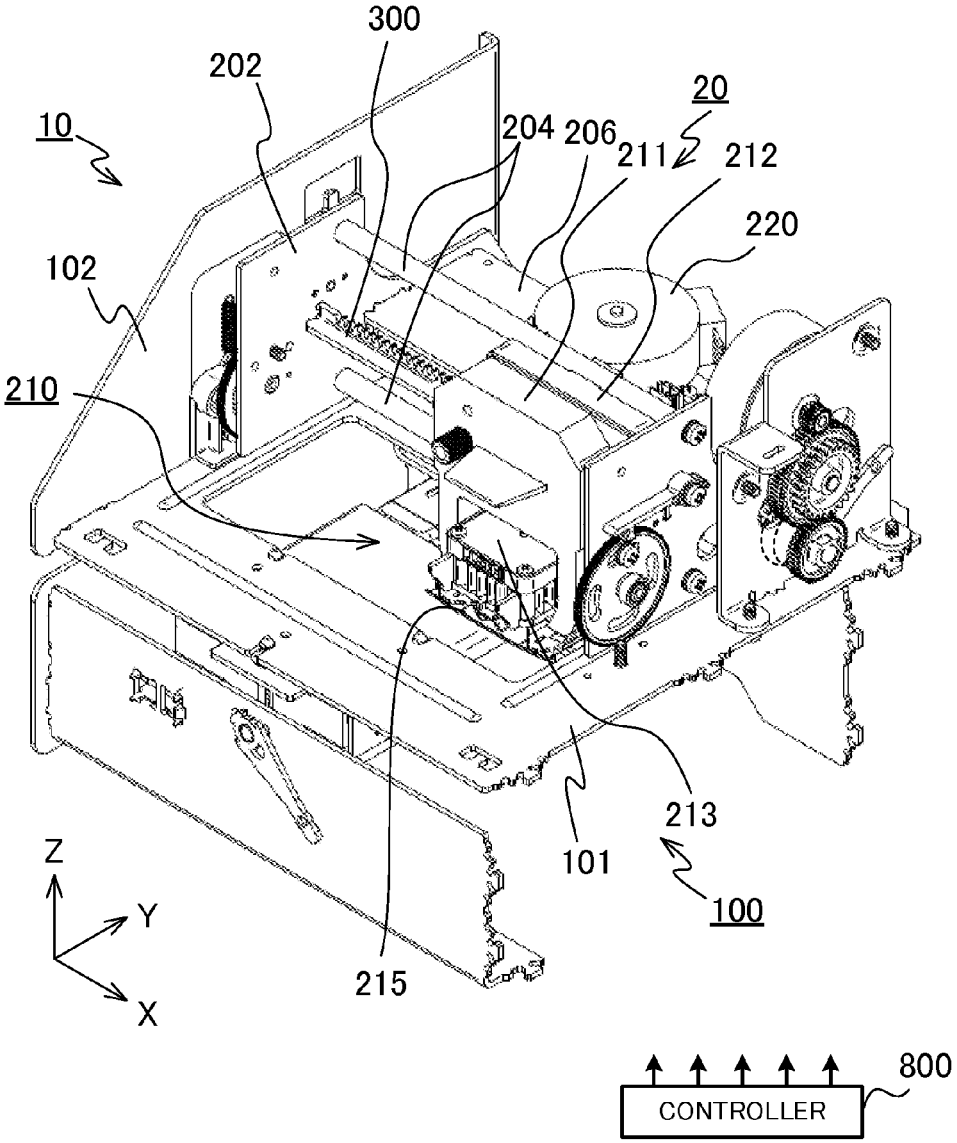
FIG. 1 is a perspective view illustrating a printing apparatus according to the present embodiment with a portion thereof removed.
Figure 2:
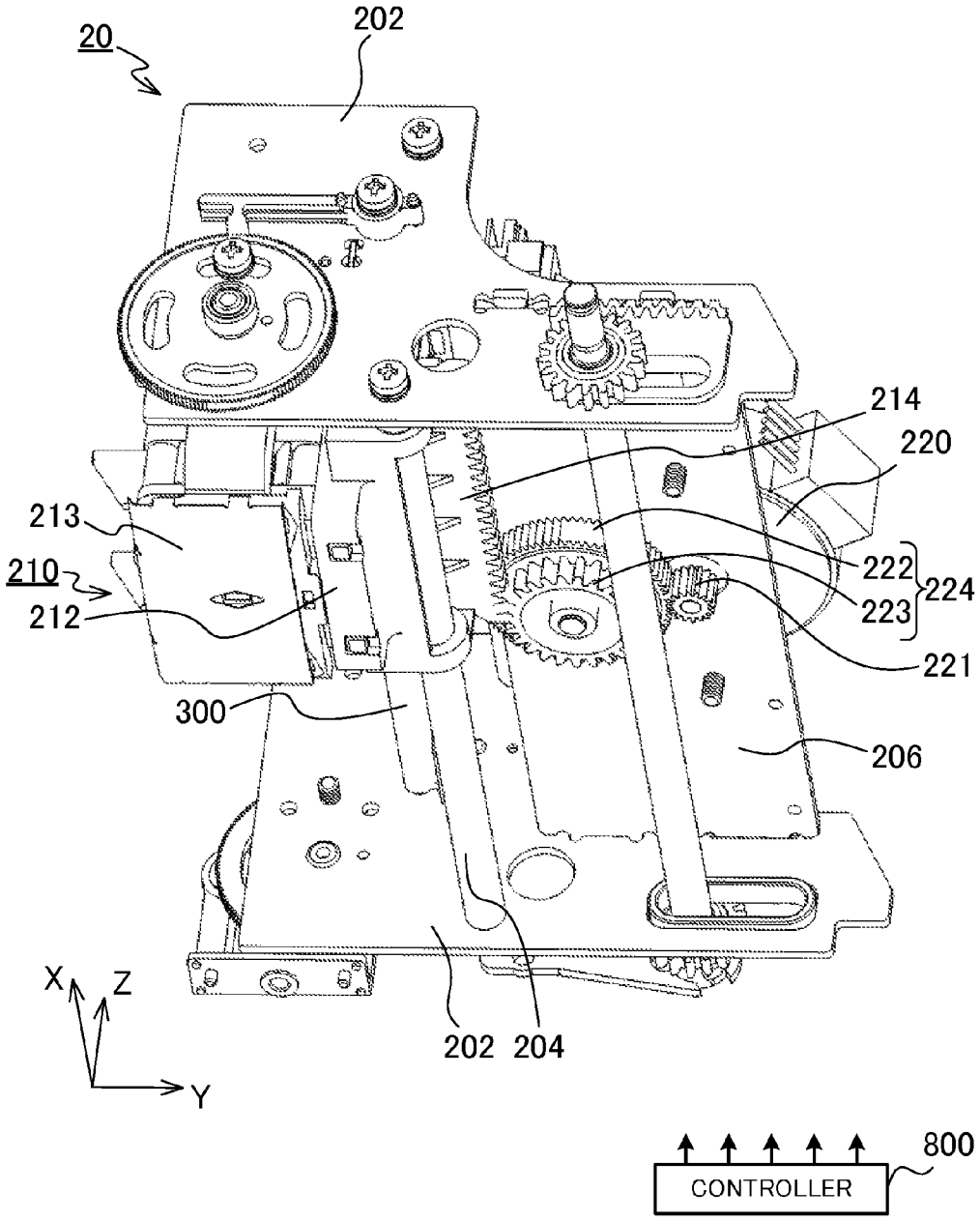
FIG. 2 is a perspective view illustrating the bottom side of a printing unit.
Figure 3:
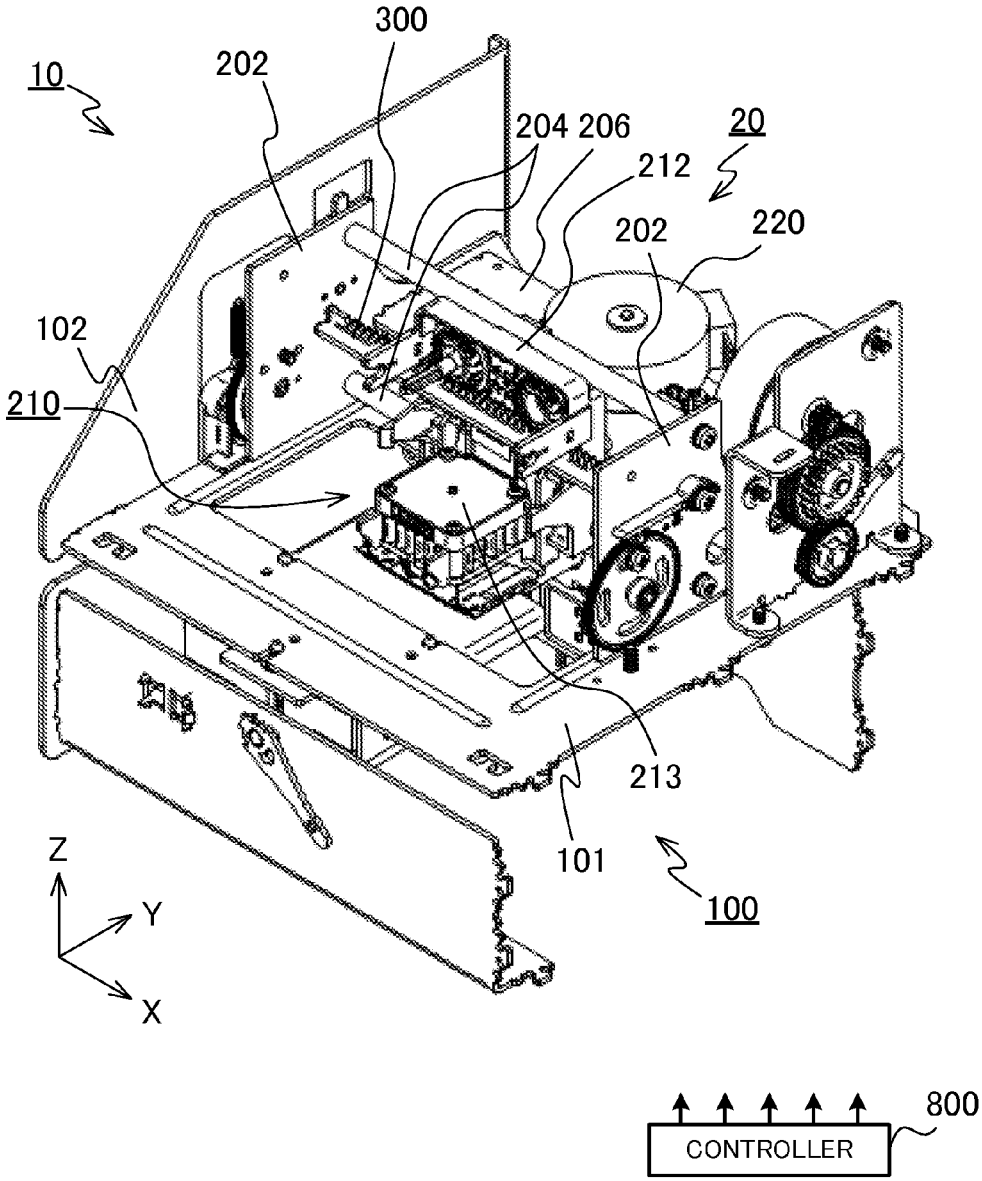
FIG. 3 is a perspective view illustrating the printing apparatus with an ink ribbon cartridge and other portions thereof removed.

As illustrated in FIGS. 1 to 3, a time recorder 10 according to an embodiment of the present invention is equipped with a dot-impact printing apparatus equipped with a housing 100, a printing unit 20 affixed inside the housing 100, and a controller 800.

Note that in order to ease understanding, in the following description the mutually orthogonal X, Y, and Z directions are defined. For the X, Y, and Z signs indicating directions illustrated in the drawings, the direction of an arrow is indicated by adding "+", the opposite direction to an arrow direction is indicated by adding "−". In the case of indicating both directions, no sign is added. The X direction corresponds to the movement direction of a carriage 210 discussed later, and is also referred to as the left-right direction. Also, the Y direction corresponds to the transport direction and the opposite direction to the transport direction of a print sheet, and is also referred to as the front-back direction. Also, the Z direction corresponds to the direction in which a wire pin discussed later moves closer to or away from a bottom housing frame (platen) 101, and is also referred to as the top-bottom direction. Hereinafter, these components constituting the printing unit 20 will be described in detail.

The housing 100 is equipped with a bottom housing frame 101 disposed parallel to the X-Y plane, and two planar side housing frames 102 erected on both sides of the bottom housing frame 101. Note that in FIGS. 1 and 3, only one of the side housing frames 102 is illustrated.

The printing unit 20 is equipped with two planar side block frames 202, a ribbon winding rack 300, two X direction guide bars 204, and a carriage 210. The ribbon winding rack 300 spans the two side block frames 202, with both ends affixed to respective side block frames 202. The carriage 210 is supported by the X direction guide bars 204 so as to enable sliding in the horizontal direction.

The carriage 210 is equipped with a cartridge mounting unit 212 onto which an ink ribbon cartridge 211 is removably mounted, and a print head 213 provided below (on the −Z side of) the ink ribbon cartridge 211. The ink ribbon cartridge 211 houses an ink ribbon.

Figure 4:
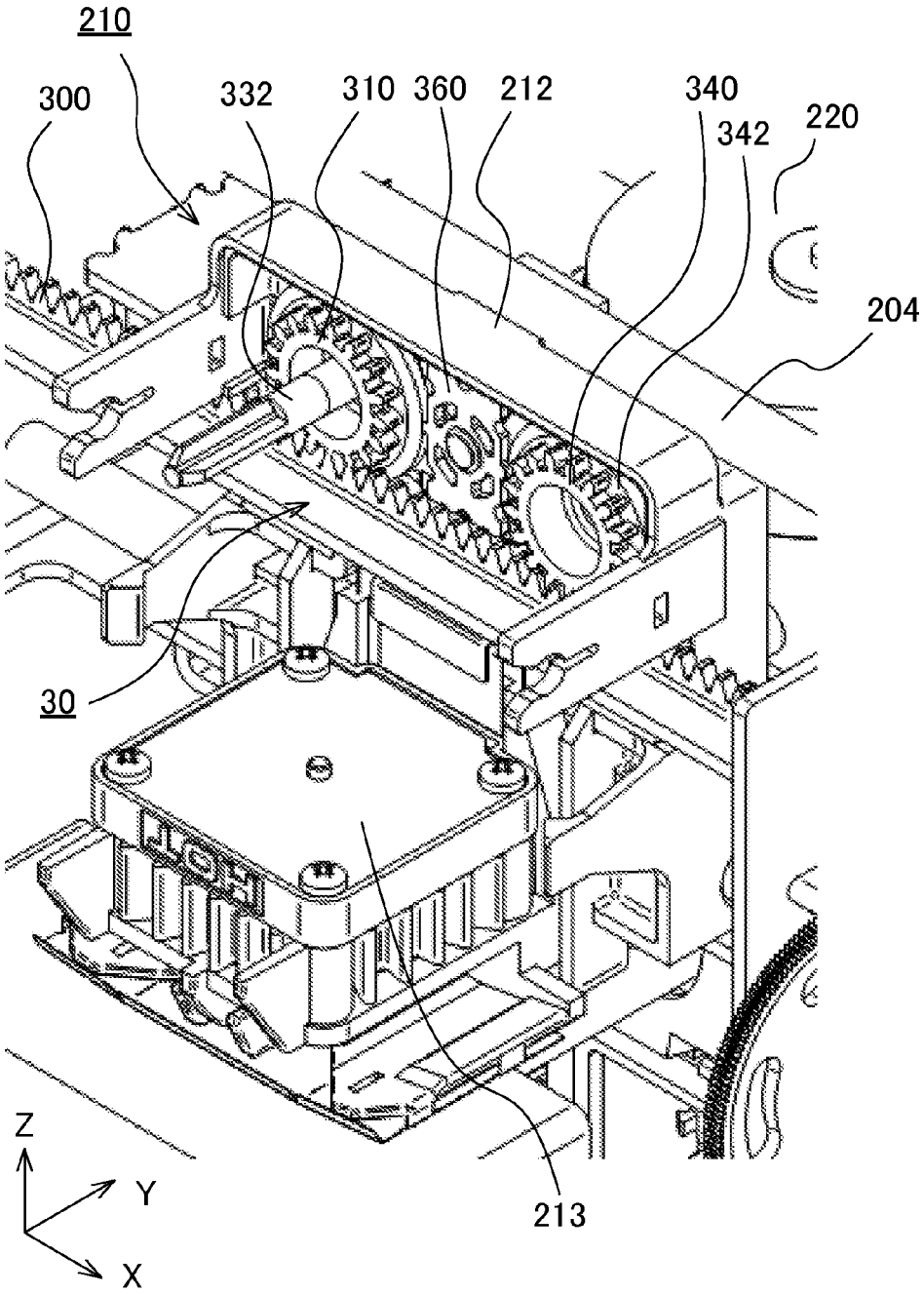
FIG. 4 is a perspective view illustrating a ribbon winding unit.
Figure 5A:
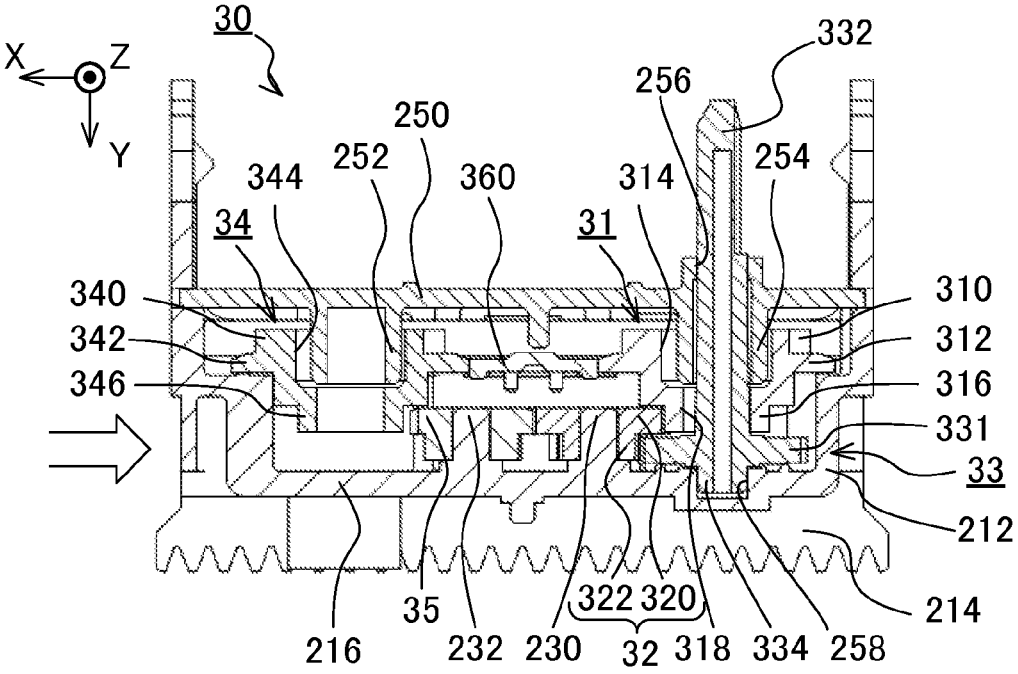
FIG. 5A is a diagram illustrating a cross-section parallel to the X-Y plane of the ribbon winding unit when a carriage moves in the −X direction.
Figure 5B:
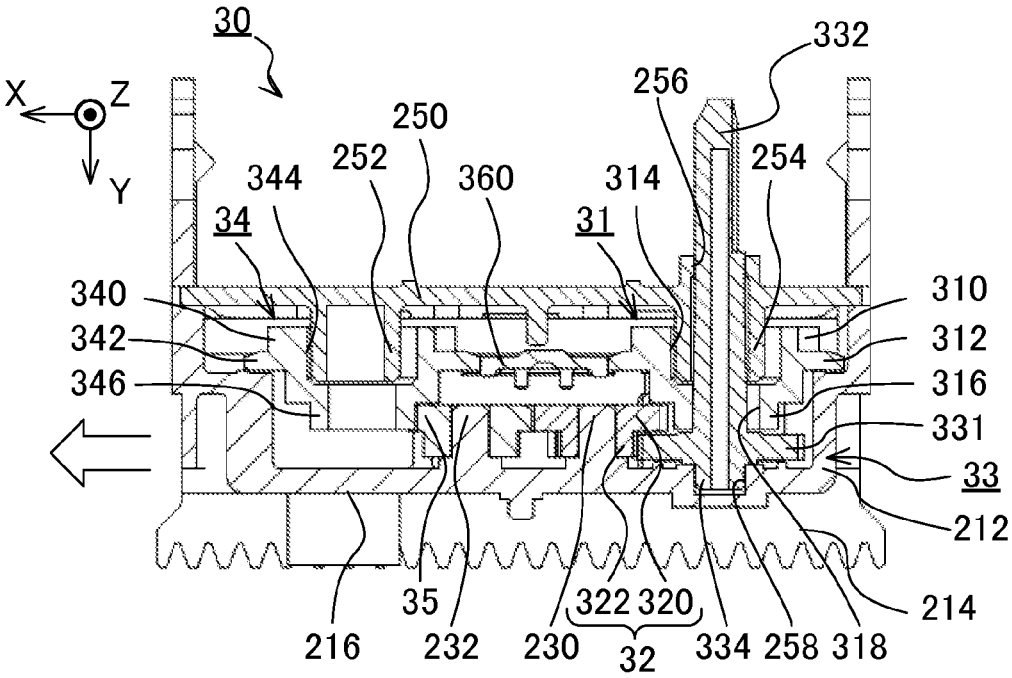
FIG. 5B is a diagram illustrating a cross-section parallel to the X-Y plane of the ribbon winding unit when the carriage moves in the +X direction.

As illustrated in FIGS. 4, 5A, and 5B, the cartridge mounting unit 212 is equipped with a ribbon winding unit 30 that includes a winding axle 332 that winds an ink ribbon, and a cover 250 (not illustrated in FIG. 4) that covers the ribbon winding unit 30 except for part of the winding axle 332. Also, an X direction rack 214 extending in the X direction is disposed parallel to the X direction guide bars 204 on a side wall 216 on the +Y side of the cartridge mounting unit 212. The X direction rack 214 engages with a small gear 223 of a double gear 224 that rotates due to a motor (driving unit) 220 discussed later, and is provided to enable movement of the carriage 210 in the X direction.

The cartridge mounting unit 212 includes a first supporting projection 230 and a second supporting projection 232 that project internally from the inner face of the side wall 216, and a supporting depression 258 formed on the inner face of the side wall 216. A given interval in the X direction is provided between the first supporting projection 230 and the second supporting projection 232. The first supporting projection 230 rotatably supports an intermediate gear (first intermediate gear) 32 discussed later. The second supporting projection 232 rotatably supports a tumbler gear (second intermediate gear) 35 discussed later. The supporting depression 258 rotatably supports a winding member 33 discussed later.

The cover 250 includes a third supporting projection 252 that projects facing inwards into the cartridge mounting unit 212, and a fourth supporting projection 254 that projects a given distance away from the third supporting projection 252 in the X direction. The third supporting projection 252 supports, rotatably and also slidably in the X direction, a second moving gear 34 discussed later. Also, the fourth supporting projection 254 supports, rotatably and also slidably in the X direction, a first moving gear 31 discussed later. The cover 250 also includes a through-hole 256, and a winding axle 332 discussed later is disposed passing through the through-hole 256 from inside the cartridge mounting unit 212 on the side where the ink ribbon cartridge 211 is mounted.

As illustrated in FIGS. 5A and 5B, the ribbon winding unit 30 is equipped with the first moving gear 31 and the second moving gear 34 that engage with the ribbon winding rack 300, the intermediate gear (first intermediate gear) 32 that engages with the first moving gear 31, the winding member 33, and the tumbler gear (second intermediate gear) 35 that engages with the second moving gear 34 and the intermediate gear 32. The first moving gear 31 and the second moving gear 34 are able to move parallel to the movement direction of the carriage 210 inside the cartridge mounting unit 212. The winding member 33 includes an output gear 331 that engages with the intermediate gear 32, and a winding axle 332 provided coaxially with the output gear 331.

The first moving gear 31 is equipped with a large gear (third gear) 310 that engages with the ribbon winding rack 300, a small gear (fourth gear) 316 that engages with a large gear (first gear) 320 of the intermediate gear 32 discussed later, and a disc-shaped flange section 312 provided between the large gear 310 and the small gear 316. The disc-shaped flange section 312 is formed with a larger diameter than the large gear 310 and the small gear 316, and abuts a spacer 360 discussed later.

The first moving gear 31 also includes, coaxially about the center axis, a hole 314 formed on the large gear 310 side, and a through-hole 318 formed on the small gear 316 and communicating with the hole 314. By having the fourth supporting projection 254 that projects from the cover 250 housed in the hole 314, the first moving gear 31 is rotatably as well as slidably supported inside the cartridge mounting unit 212. In addition, a winding axle 332 discussed later is inserted into the through-hole 318 of the first moving gear 31, and the winding axle 332 passes through the through-hole 318 of the first moving gear 31 and the through-hole 256 of the cover 250 to project in the Y axis direction. Note that the winding axle 332 is pivotably supported by the cover 250 due to passing through the through-hole 256 of the cover 250, and thus does not move in accordance with sliding of the first moving gear 31.

The second moving gear 34 is equipped with a large gear (fifth gear) 340 that engages with the ribbon winding rack 300, a small gear (sixth gear) 346 that engages with the tumbler gear 35 discussed later, and a disc-shaped flange section 342 formed between the large gear 340 and the small gear 346. The flange section 342 is formed with a larger diameter than the large gear 340 and the small gear 346, and abuts a spacer 360 discussed later.

The second moving gear 34 also includes, coaxially about the center axis, a hole 344 formed on the large gear 340 side. By having the third supporting projection 252 that projects from the cover 250 housed in the hole 344, the second moving gear 34 is rotatably supported inside the cartridge mounting unit 212, as well as being supported so as to enable sliding in the X direction.

A plate tile spacer 360 is disposed between the flange section 312 of the first moving gear 31 and the flange section 342 of the second moving gear 34. The spacer 360 is disposed so as to be movable in the same direction as the movement direction of the first moving gear 31 and the second moving gear 34. By abutting (point contact) the flange section 312 and the flange section 342, the spacer 360 keeps a minimum inter-axial distance between the first moving gear 31 and the second moving gear 34.

The intermediate gear 32 is a double gear made up of a large gear 320 and a small gear (second gear) 322, and is rotatably supported by the first supporting projection 230 as described above. As described above, the large gear 320 engages with the tumbler gear 35 and the small gear 316 of the first moving gear 31. The small gear 322 engages with an output gear 331 as described above.

The winding member 33 is made up of an output gear 331 and a winding axle 332 disposed integrally and coaxially with the output gear 331. The output gear 331 is disposed so as to engage with the small gear 322. The output gear 331 is designed such that the rotational speed (winding speed) of the winding member 33 is adjusted to a suitable speed by the gear ratio with the small gear 322, and is formed with a larger diameter (more teeth) than the small gear 322 of the intermediate gear 32. The winding member 33 is configured such that one end of the winding axle 332 is rotatably supported by the supporting depression 258 as described above, while the other end of the winding axle 332 is inserted into a cartridge 211 in order to wind an ink ribbon.

As described above, the tumbler gear 35 is rotatably supported by the second supporting projection 232. As described above, the tumbler gear 35 engages with the large gear 320 of the intermediate gear 32 and the small gear 346 of the second moving gear 34.

As illustrated in FIG. 2, as structural components related to the horizontal movement of the carriage 210, the printing unit 20 is additionally equipped with a motor 220 and a double gear 224 that transmits the rotational power of the motor 220 to the X direction rack 214.

The motor 220 is disposed on a mounting plate 206 spanning the side block frames 202 on either side. Also, a pinion 221 is integrally affixed to a rotary axle of the motor 220, and the pinion 221 projects below the mounting plate 206.

The double gear 224 is made up of a large gear 222 that engages with the pinion 221 and a small gear 223 that engages with the X direction rack 214, and is rotatably supported on the bottom face of the mounting plate 206.

The controller 800 illustrated in FIG. 1 is made up of a microprocessor that includes a CPU (central processing unit) and memory, a motor driver circuit, or the like, and drives the motor 220 according to a control program stored in memory.

The motor 220, under control by the controller 800, causes the motor's rotary axle and the pinion 221 to rotate, thus causing the double gear 224 to rotate. Due to the double gear 224 rotating, the carriage 210 moves in the X direction via the X direction rack 214.

(Operation of Ribbon Winding Unit 30)

Figure 6A:
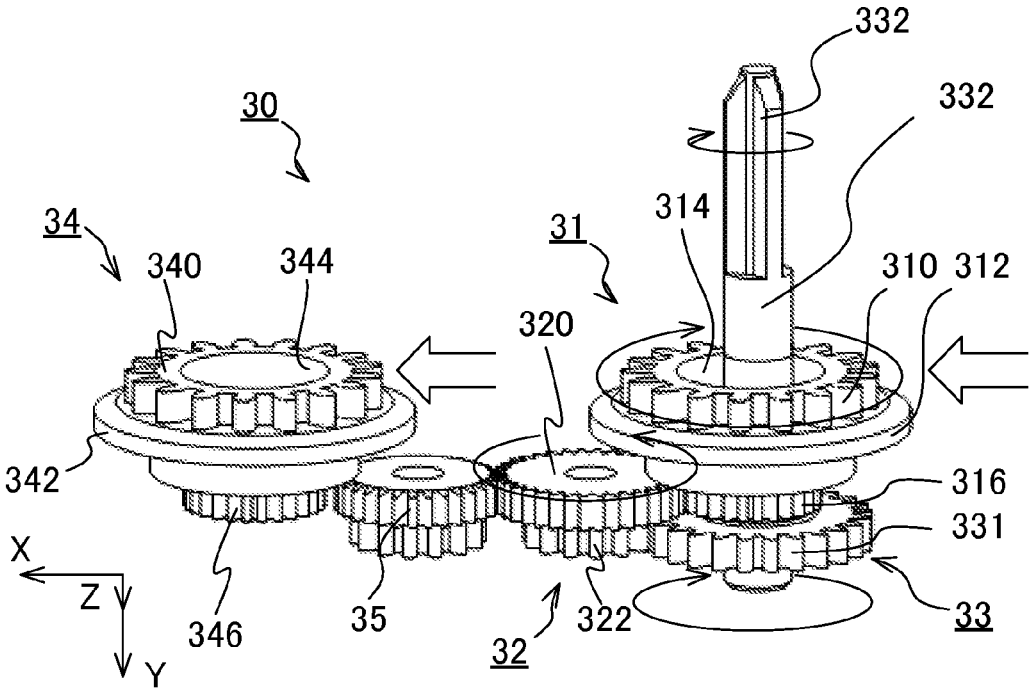
FIG. 6A is a perspective view of the ribbon winding unit when a first moving gear and a second moving gear move in the +X direction inside a cartridge mounting unit.
Figure 6B:
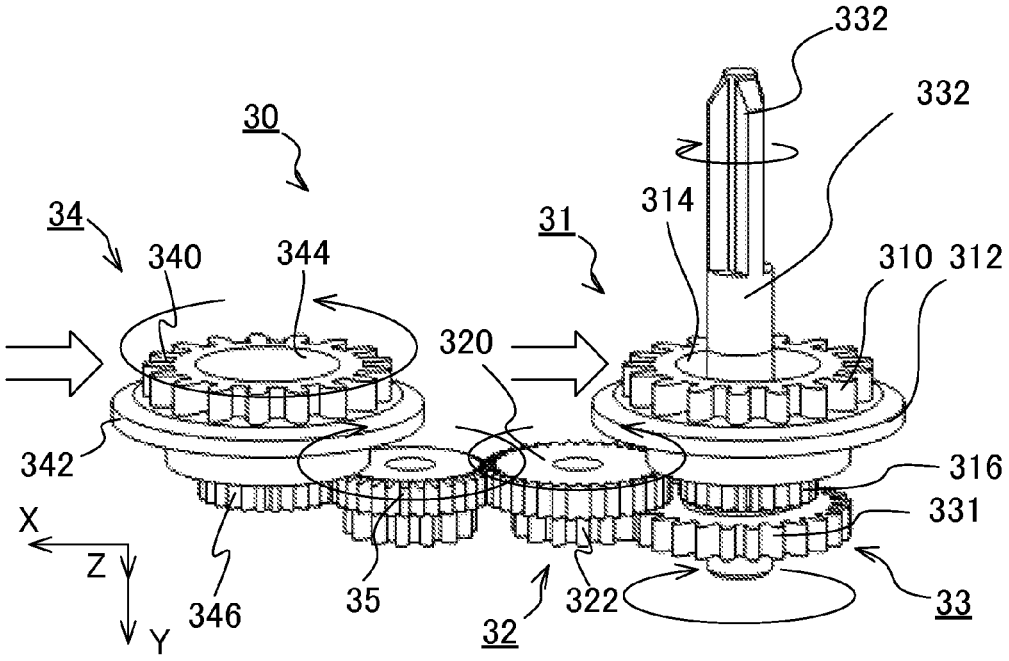
FIG. 6B is a perspective view of the ribbon winding unit when the first moving gear and the second moving gear move in the −X direction inside the cartridge mounting unit.

Next, operation of the ribbon winding unit 30 according to the movement direction of the carriage 210 will be described with reference to FIGS. 5A, 5B, 6A, and 6B. Note that the block arrows illustrated in FIGS. 5A and 5B illustrate the movement direction of the cartridge mounting unit 212 (carriage 210). The block arrows illustrated in FIGS. 6A and 6B illustrate the movement direction of the first moving gear 31 and the second moving gear 34 inside the cartridge mounting unit 212 (carriage 210). Also, the circular arrows indicate the rotational directions of gears that contribute to the rotation of the winding axle 332.

First, in the case where the carriage 210 moves in the −X direction, the faces on the −X side of the teeth of the large gear 310 and the large gear 340 abut the peaks of the ribbon winding rack 300. Thus, the first moving gear 31 and the second moving gear 34 move in the +X direction inside the cartridge mounting unit 212, as illustrated in FIGS. 5A and 6A. Due to this movement of the first moving gear 31 and the second moving gear 34, the small gear 316 of the first moving gear 31 engages with the large gear 320 of the intermediate gear 32, while the small gear 346 of the second moving gear 34 disengages from the tumbler gear 35. In other words, the second moving gear 34 spins freely.

By having the faces on the −X side of the teeth of the large gear 310 abut the faces on the +X side of the peaks of the ribbon winding rack 300, the first moving gear 31 moves as above, while also rotating counter-clockwise in FIG. 6A. Due to this rotation, the small gear 316 that is part of the first moving gear 31 rotates together integrally. The large gear 320 engaged with this small gear 316 then rotates clockwise. Due to the large gear 320 rotating, the small gear 322 integrally formed therewith also rotates at the same rotational speed. The output gear 331 rotates counter-clockwise in response to the rotation of the engaged small gear 322. Then, the winding axle 332 integrally formed with the output gear 331 rotates counter-clockwise, which is the same direction as the rotation of the first moving gear 31, thus winding an ink ribbon. The second moving gear 34 spins freely at this point as discussed above, and thus is not involved in the winding of the ink ribbon.

Next, in the case where the carriage 210 moves in the +X direction, the faces on the +X side of the teeth of the large gear 310 and the large gear 340 abut the faces on the −X sides of the peaks of the ribbon winding rack 300. Thus, the first moving gear 31 and the second moving gear 34 moves in the −X direction inside the cartridge mounting unit 212, as illustrated in FIGS. 5B and 6B. Due to this movement of the first moving gear 31 and the second moving gear 34, the small gear 346 of the second moving gear 34 engages with the tumbler gear 35, while the small gear 316 of the first moving gear 31 disengages from the large gear 320 of the intermediate gear 32. In other words, the first moving gear 31 spins freely.

By having the faces on the +X side of the teeth of the large gear 340 abut the peaks of the ribbon winding rack 300, the second moving gear 34 moves as above, while also rotating clockwise in FIG. 6B. Due to this rotation, the small gear 346 that is part of the second moving gear 34 rotates together integrally. The tumbler gear 35 engaged with the small gear 346 then rotates counter-clockwise. The large gear 320 engaged with the tumbler gear 35 then rotates clockwise. Due to the large gear 320 rotating, the small gear 322 integrally formed therewith also rotates at the same rotational speed. The output gear 331 rotates counter-clockwise in response to the rotation of the engaged small gear 322. Then, the winding axle 332 integrally formed with the output gear 331 rotates counter-clockwise, which is the same direction as in the case where the carriage 210 moves in the −X direction, thus winding an ink ribbon. The first moving gear 31 spins freely at this point as discussed above, and thus is not involved in the winding of the ink ribbon.

In this way, regardless of the direction in which the carriage 210 moves (the −X direction or the +X direction), the winding axle 332 rotates counter-clockwise in FIGS. 6A and 6B, thus winding an ink ribbon in a given direction.

The ribbon winding unit 30 of the time recorder 10 according to the present embodiment is equipped with a first moving gear 31 which is hollow, an intermediate gear 32 which is a double gear, and a winding member 33 that includes a winding axle 332. The double gear of the intermediate gear 32 is made up of a large gear 320 that engages with the first moving gear 31, and a small gear 322. The winding axle 332 of the winding member 33 passes through the output gear 331 that engages with the small gear 322, and the first moving gear 31. With this configuration the first moving gear 31 and the winding axle 332 may be disposed overlapping in the Y axis direction. Thus, it is possible to reduce the size of the cartridge mounting unit 212 in the diametric directions of each gear (the X direction and the Z direction).

Note that, according to this configuration, although the size does increase in the thickness direction of the gears in the cartridge mounting unit 212, the width of this increase is small, being approximately the thickness of the output gear 331. Also, since this thickness extends into locations corresponding to what was already free space inside the time recorder 10, the thickness does not pose a problem with respect to making the time recorder 10 more compact.

Furthermore, in the winding gear mechanism disclosed in the above Patent Literature 1, the moving gears are disposed so as to engage with a rack, projecting from two gears that engage with the moving gears on a face parallel thereto. On the other hand, in the present embodiment, in the ribbon winding unit 30 there is disposed only a spacer 360, which is a tile that does not project from the two gears that directly engage with the ribbon winding rack 300 (the first moving gear 31 and the second moving gear 34) on a face parallel thereto. For this reason, the cartridge mounting unit 212 may be made smaller to the extent of this space.

Also, a minimum inter-axial distance between the first moving gear 31 and the second moving gear 34 is kept by the spacer 360, thereby preventing a state which both the first moving gear 31 and the intermediate gear 32, as well as the second moving gear 34 and the tumbler gear 35, are engaged. For this reason, even in the case where foreign matter has lodged between the first moving gear 31 or the second moving gear 34 and the ribbon winding rack 300, between the hole 314 of the first moving gear 31 and the third supporting projection 252, or between the hole 344 of the second moving gear 34 and the fourth supporting projection 254, for example, the first moving gear 31 and the second moving gear 34 do not simultaneously enter an engaged state with the intermediate gear 32 and the tumbler gear 35, and an impossible load is not produced. Thus, damage to the gears (the first moving gear 31, the second moving gear 34, the intermediate gear 32, and the tumbler gear 35) is prevented.

On the other hand, in the case where foreign matter lodges between the first moving gear 31 or the second moving gear 34 and their surroundings, a state in which neither the first moving gear 31 nor the second moving gear 34 is engaged with the intermediate gear 32 or the tumbler gear 35 may occur. In such cases, torque is not transmitted all the way to the winding axle 332, and an ink ribbon will stop being wound. In this case, although a failure does occur in that printing onto a print sheet is no longer performed, a user is able to ascertain that a problem has occurred and conduct repair work to remove the foreign matter. Note that even in such cases, an impossible load is not produced in the engagement relationships between the first moving gear 31 and the intermediate gear 32 as well as the second moving gear 34 and the tumbler gear 35, and thus these gears will not be damaged.

Thus, as described above, in a ribbon winding unit 30 of a time recorder 10 according to the present embodiment, a first moving gear 31 and a second moving gear 34 directly engage with a ribbon winding rack 300. For this reason, the first moving gear 31 and the second moving gear 34 abut the ribbon winding rack 300 and rotate, providing torque to a winding axle 332 of a winding member 33 via (the tumbler gear 35 and) an intermediate gear 32.

Also, depending on the movement direction of the carriage 210, the configuration automatically switches between a state in which the first moving gear 31 and the intermediate gear 32 engage while the second moving gear 34 and the tumbler gear 35 disengage, and a state in which the first moving gear 31 and the intermediate gear 32 disengage while the second moving gear 34 and the tumbler gear 35 engage.

In other words, it is possible to make the cartridge mounting unit 212, the carriage 210, and by extension, the time recorder 10 more compact to the extent that extra moving gears are not provided.

Also, the ribbon winding unit 30 is equipped with a first moving gear 31 which is hollow, the large gear 320 that engages with the first moving gear 31 and a tumbler gear 35, the intermediate gear 32 made up of a double gear with a small gear 322, and the winding member 33 that includes a winding axle 332 inserted (passing through) an output gear 331 that engages with the small gear 322, and the first moving gear 31. Due to such a configuration, the size of the ribbon winding unit 30 becomes compact in the diametric direction of each gear. Furthermore, by adjusting the gear ratio of each engaging gear, the ribbon winding unit 30 will have a torque (and rotational speed) suitable for winding an ink ribbon, even with a compact size. Note that the relative sizes of gears in the present embodiment are examples, and the invention is not particularly limited thereto.

In order to obtain a rotational speed suitable for winding an ink ribbon, the gear ratios of the first moving gear 31 and/or the second moving gear 34 as a double gear with the intermediate gear 32 and/or the tumbler gear 35 may be adjusted. With such a configuration, the size of the first moving gear 31 and/or the second moving gear 34 become compact in the radial direction.

Also, since the spacer 360 is configured to make point contact with each of a disc-shaped flange section 312 and a flange section 342, the spacer 360 is unlikely to slip since force is not applied except in the contact direction (the same direction as the extension direction of the flange section 312 and the flange section 342), and is able to reliably keep a minimum inter-axial distance between the first moving gear 31 and the second moving gear 34.

Although the foregoing embodiment describes an example of applying the present invention to a dot-impact-type time recorder, the present invention may also be applied to thermal transfer devices, and may be used in printers, fax machines, and other printing apparatus that require winding of an ink ribbon.

Note that various embodiments and modifications of the present invention are possible without departing from the scope and spirit of the present invention in the broad sense. Furthermore, the foregoing embodiments are for the purpose of describing the present invention, and do not limit the scope of the present invention. In other words, the scope of the present invention is indicated by the claims rather than the embodiments. In addition, various alterations performed within the scope of the claims or within an equivalent scope of the significance of the present invention are to be regarded as being within the scope of the present invention.

The present invention is based on Japanese Patent Application No. 2012-010980 filed in the Japan Patent Office on Jan. 23, 2012. The entirety of the specification, claims, and drawings of Japanese Patent Application No. 2012-010980 are hereby incorporated by reference.

REFERENCE SIGNS LIST

10 Time recorder (printing apparatus)
210 Carriage
213 Print head (printing section)
215 Ink ribbon
220 Motor (driving unit)
30 Ribbon winding unit
300 Ribbon winding rack
31 First moving gear
310 Large gear (third gear)
312 Range section
316 Small gear (fourth gear)
32 Intermediate gear (first intermediate gear)
320 Large gear (first gear)
322 Small gear (second gear)
33 Winding member
331 Output gear
332 Winding axle
34 Second moving gear
340 Large gear (fifth gear)
342 Range section
346 Small gear (sixth gear)
35 Tumbler gear (second intermediate gear)
360 Spacer
800 Controller

What is claimed is:

1. A printing apparatus, characterized by comprising:

a rack;

a carriage equipped with a printing section and a winding unit that includes a winding axle that winds an ink ribbon; and a driving unit that causes the carriage to move along the rack;

wherein the winding unit includes a first moving gear that engages with the rack, is slidably supported by the carriage, and rotates according to movement of the carriage, while also, due to force applied from the rack during movement of the carriage, moving in an opposite direction inside the carriage with respect to movement of the carriage in a given direction, and moving in the given direction inside the carriage with respect to movement of the carriage in the opposite direction, a second moving gear that engages with the rack, is slidably supported by the carriage, and rotates according to movement of the carriage, while also, due to force applied from the rack during movement of the carriage, moving in an opposite direction inside the carriage with respect to movement of the carriage in a given direction, and moving in the given direction inside the carriage with respect to movement of the carriage in the opposite direction, a first intermediate gear that engages with the first moving gear when the first and second moving gears move in the given direction inside the carriage, and disengages from the first moving gear when the first and second moving gears move in the opposite direction inside the carriage, a second intermediate gear that engages with the first intermediate gear, engages with the second moving gear when the first and second moving gears move in the opposite direction inside the carriage, and disengages from the second moving gear when the first and second moving gears move in the given direction inside the carriage, and a winding member that includes the winding axle and an output gear, disposed coaxially with the winding axle, that engages with the first intermediate gear.

2. The printing apparatus according to claim 1, wherein the first moving gear is hollow inside, the first intermediate gear is a double gear including a first gear that engages with the first moving gear, and a second gear, the output gear engages with the second gear, and the winding member is disposed such that the winding axle is inserted into the first moving gear.

3. The printing apparatus according to claim 1, wherein the first moving gear is a double gear including a third gear that engages with the rack, and a fourth gear, disposed coaxially with the third gear, that engages with the first intermediate gear, and the second moving gear is a double gear including a fifth gear that engages with the rack, and a sixth gear, disposed coaxially with the fifth gear, that engages with the second intermediate gear.

4. The printing apparatus according to claim 1, wherein the carriage is equipped with a spacer between the first moving gear and the second moving gear that abuts the first moving gear and the second moving gear, and is movable in the same direction as a movement direction of the first moving gear and the second moving gear.

5. The printing apparatus according to claim 4, wherein the first moving gear and the second moving gear include a flange section that projects out radially, and the spacer is disposed at a position able to abut both the flange sections of the first moving gear and the second moving gear.

* * * * *

UNITED STATES PATENT AND TRADEMARK OFFICE

CERTIFICATE OF CORRECTION

PATENT NO. : 9,011,029 B2
APPLICATION NO. : 14/342453
DATED : April 21, 2015
INVENTOR(S) : Koji Ehara It is certified that error appears in the above-identified patent and that said Letters Patent is hereby corrected as shown below:

In the Specification

Column 9, Line 52: Please delete "312 Range section" and replace with -- 312 Flange section --.

Column 9, Line 62: Please delete "342 Range section" and replace with -- 342 Flange section --.

Signed and Sealed this
Tenth Day of November, 2015

Michelle K. Lee

Michelle K. Lee
*Director of the United States Patent and Trademark Office*